United States Patent [19]

Ogura et al.

[11] 4,447,318

[45] May 8, 1984

[54] EXTRACTIVE DISTILLATION METHOD

[75] Inventors: Shunichiro Ogura, Tokyo; Masafumi Miyamoto, Ami, both of Japan

[73] Assignee: Nippon Zeon Co., Ltd., Tokyo, Japan

[21] Appl. No.: 479,725

[22] Filed: Mar. 28, 1983

[30] Foreign Application Priority Data

Mar. 29, 1982 [JP] Japan ..... 57-50688

[51] Int. Cl.[3] ..... C10G 7/08; C10G 7/00; B01D 3/00; B01D 3/40

[52] U.S. Cl. ..... 208/348; 208/353; 203/25; 203/81; 203/82; 203/74; 203/75; 203/60

[58] Field of Search ..... 208/348, 353; 203/57, 203/60, 74, 75, 81, 82, 23, 25

[56] References Cited

U.S. PATENT DOCUMENTS

| | | | |
|---|---|---|---|
| 2,033,472 | 3/1936 | Keith, Jr. | 208/353 |
| 3,436,436 | 4/1969 | Takao et al. | 203/60 |
| 4,076,595 | 2/1978 | Haskell | 203/57 |

FOREIGN PATENT DOCUMENTS

| | | | |
|---|---|---|---|
| 1948433 | 9/1969 | Fed. Rep. of Germany | 208/348 |
| 2911394 | 3/1979 | Fed. Rep. of Germany | 203/60 |
| 17411 | 6/1970 | Japan | 208/348 |
| 41323 | 10/1972 | Japan | 208/348 |
| 83421 | 7/1981 | Japan | 208/348 |

OTHER PUBLICATIONS

Wagner et al., "BASF Process for Production of Pure Butadiene" I.E.C., vol. 62, No. 4, Apr. 1970, pp. 43–48.

*Primary Examiner*—Delbert E. Gantz
*Assistant Examiner*—Chung K. Pak
*Attorney, Agent, or Firm*—Sherman & Shalloway

[57] ABSTRACT

In a method for separating a hydrocarbon mixture into relatively difficultly soluble hydrocarbons and relatively easily soluble hydrocarbons by extractive distillation using a polar solvent comprising feeding the starting hydrocarbon mixture to at least two evaporators, an extractive distillation column, a stripping column and a rectifying column; the improvement wherein (1) the polar solvent discharged at a high temperature from the bottom of the stripping column is recycled to the extractive distillation column after it has been cooled to a suitable temperature by giving up heat to a reboiler of the extractive distillation column, a reboiler of the rectifying column and successively to the two or more evaporators, and (2) the starting hydrocarbon mixture is divided into two or more streams and heated in two or more evaporators, one stream being evaporated in a first evaporator to a pressure necessary for introduction into the extractive distillation column and then fed to the extractive distillation column, and the other stream, after evaporation in a second and subsequent evaporators, being pressurized to a pressure required for introduction into the extractive distillation column by means of a compressor and then fed into the extractive distillation column.

7 Claims, 2 Drawing Figures

EXTRACTIVE DISTILLATION METHOD

BACKGROUND OF THE INVENTION

This invention relates to an improvement in a method for extractive distillation of a hydrocarbon mixture, particularly a $C_4$ or $C_5$ hydrocarbon mixture. More specifically, this invention relates to an improvement in an extractive distillation method comprising distilling the hydrocarbon mixture in a polar solvent to withdraw relatively difficultly soluble hydrocarbons from the top of the distillation column and simultaneously withdraw a solvent solution containing relatively easily soluble hydrocarbons from the bottom of the distillation column.

The term "relatively difficultly soluble hydrocarbons" and "relatively easily soluble hydrocarbons" as used in the present invention express the solubility of hydrocarbons in a polar solvent in a comparative manner. For example, when the hydrocarbon mixture is an olefin-diolefin mixture, olefins are the relatively difficultly soluble hydrocarbons and diolefins are the relatively easily soluble hydrocarbons. When the hydrocarbon mixture is a paraffin-olefin mixture, paraffins are the relatively difficultly soluble hydrocarbons and olefins are the relatively easily soluble hydrocarbons. Table 1 summarizes the solubilities of $C_4$ hydrocarbons in dimethylformamide and N-methylpyrrolidone which are typical polar solvents.

TABLE 1

| Components | Boiling point (°C.) | Solubility in dimethylformamide (vol/vol/1 atm.) | Solubility in N—methyl-pyrrolidone (vol/vol/1 atm.) |
|---|---|---|---|
| iso-Butane | −11.7 | 9.2 (20° C.) | 4.87 (40° C.) |
| n-Butane | −0.50 | 16.5 (25° C.) | 9.5 (40° C.) |
| Butene-1 | −6.26 | 24.6 (25° C.) | 15.6 (40° C.) |
| iso-Butene | −6.90 | 28.0 (25° C.) | 15.4 (40° C.) |
| trans-Butene-2 | +0.88 | 35.5 (25° C.) | 20.4 (40° C.) |
| cis-Butene-2 | +3.72 | 51.0 (25° C.) | 25.1 (40° C.) |
| 1,3-Butadiene | −4.41 | 83.4 (25° C.) | 41.5 (40° C.) |
| 1,2-Butadiene | +10.85 | 160.0 (25° C.) | 78.0 (40° C.) |

$C_4$ and $C_5$ hydrocarbon mixtures contain butadiene and isoprene which are important materials for synthetic rubbers and synthetic resins. As olefins, isobutene attracts attention as a material for methyl methacrylate, and n-butene, as a material for maleic anhydride and dehydrogenated butadiene.

Methods for separating these effective ingredients from $C_4$ and $C_5$ hydrocarbon mixtures by extractive distillation using polar solvents are disclosed, for example, in Japanese Patent Publication Nos. 17405/1970, 17411/1970 and 41323/1972 and Japanese Laid-Open Patent Publication No. 83421/1981.

Extractive distillation is carried out usually in an apparatus composed of an extractive distillation column and a stripping column. Olefins and/or diolefins which are easily soluble hydrocarbons in the $C_4$ and $C_5$ hydrocarbon mixture are withdrawn in the form of a mixture from the bottom of the extractive distillation column and sent to the stripping column where they are separated into the hydrocarbons and the solvent. Generally, the stripping column is operated at a pressure of 0.5 to 5 atmospheres, and the polar solvent substantially free from hydrocarbons is withdrawn at its boiling point under the above pressure from the bottom of the stripping column. Since this solvent is usually at a high temperature of 100° to 200° C., it is returned to the extractive distillation column after its thermal energy is recovered by using it as a heat source for a reboiler of the extractive distillation column and/or a material evaporator (H. Wagner and et al., I. E. C. Vol. 62, No. 4, April 1970, pages 43–48).

The present inventors have variously studied a method for efficiently recovering heat from a solvent which is discharged at a high temperature from the bottom of a stripping column in extractive distillation, and consequently found a method of thoroughly recovering and utilizing the heat of the solvent.

SUMMARY OF THE INVENTION

Thus, according to this invention, there is provided a method for extractive distillation which comprises separating a hydrocarbon mixture into relatively difficultly soluble hydrocarbons and relatively easily soluble hydrocarbons by extractive distillation with a polar solvent and including feeding the starting hydrocarbon mixture to two or more evaporators, an extractive distillation column, a stripping column and a rectifying column, characterized in that (1) the polar solvent discharged at a high temperature from the bottom of the stripping column is recycled to the extractive distillation column after it has been cooled to a suitable temperature by giving up heat to a reboiler of the extractive distillation column, a reboiler of the rectifying column and successively to the two or more evaporators, and (2) the starting hydrocarbon mixture is divided into two streams and heated in two or more evaporators; the first stream is evaporated in a first evaporator to a pressure necessary for introduction into the extractive distillation column and then fed to the extractive distillation column, and the other stream, after evaporation in a second and subsequent evaporators, is pressurized to a pressure required for introduction into the extractive distillation column by means of a compressor and then is fed into the extractive distillation column.

The polar solvent used in the present invention include all polar solvents which are usually employed in extractively distilling diolefins from a hydrocarbon fraction. Examples include N-alkyl-substituted lower fatty acid amides such as dimethylformamide, diethylformamide and dimethylacetamide; furfural; N-methylpyrrolidone; formylmorpholine; and $\beta$-methoxypropionitrile. These polar solvents may be used singly or as a mixture of two or more. Furthermore, to adjust the boiling poing of the solvent, a suitable amount of water, methanol, and the like may be mixed. It is also possible to use a polymerization inhibitor for inhibiting polymerization of diolefins, acetylenes, etc., an antioxidant, an antifoamer, etc. Various polymerization inhibitors having the property of inhibiting polymerization and/or chain transferring can be used, and in particular, t-butylcatechol, sulfur, sodium nitrite, benzaldehyde, aromatic nitro compounds, etc. may be used alone or as a mixture of two or more.

DETAILED DESCRIPTION OF THE INVENTION

Figure 1:
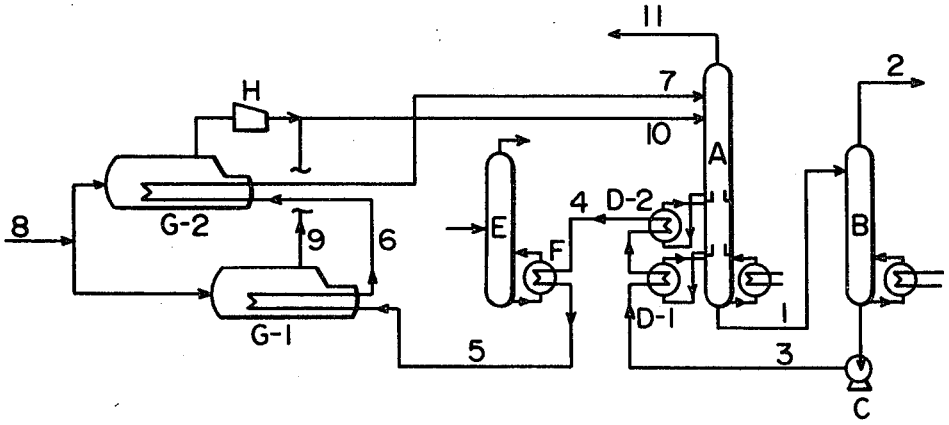
FIG. 1 is a diagram showing a preferred embodiment of the present invention.

In the method (invention) of FIG. 1, a polar solvent containing relatively easily soluble hydrocarbons from the bottom of an extractive distillation column (A) composed of 100 trays is fed through line 1 into stripping column (B) at a position several trays from its top, where the solvent is separated from the hydrocarbons. Usually, the pressure of the inside of the column is 0.5 to 5 atmospheres, and the temperature at the bottom of the column is the boiling point of the polar solvent at the above pressure. From the top of the stripping column, diolefins and/or olefins are withdrawn through line 2 and subjected to a purifying procedure in a rectifying column (E) to obtain the desired hydrocarbon components. From the bottom of the stripping column (B), only the solvent at a high temperature (usually 100° to 200° C.) is withdrawn, boosted to a predetermined pressure by means of a pump (C), and sent to reboilers (D-1) and (D-2) at the bottom of the extractive distillation column through line 3 to recover heat. The reboiler consists of one heat exchanger or two or more series- or parallel-connected heat exchangers, but is not restricted thereto. The solvent discharged from the reboiler (D-2) is sent to a reboiler (F) of the rectifying column (E) through line 4 to recover heat again. The polar solvent discharged from the reboiler (F) is sent to first material evaporator (G-1) through line 5, and then into second material evaporator (G-2) to recover heat in these evaporators. As a result, the solvent is cooled to a suitable temperature. In order to use it again for extractive distillation, the solvent is recycled through line 7 to that position of the extractive distillation column which is several trays below its top.

On the other hand, the starting hydrocarbon mixture is divided and fed into evaporators (G-1) and (G-2) through line 8. Since the polar solvent as a heat source for the evaporator (G-1) has a sufficiently high temperature, the starting hydrocarbon mixture can be evaporated to a pressure necessary and sufficient for feeding the starting hydrocarbon mixture into the extractive distillation column. The evaporated gas is fed to the extractive distillation column (A) through line 10. However, since the temperature of the polar solvent has already decreased when it reaches the second evaporator (G-2), sufficient pressure cannot be applied to the gas evaporated in the second evaporator. Accordingly, the gas evaporated in the second evaporator (G-2) is boosted by a compressor (H), combined with the gas from evaporator (G-1) and fed to the extractive distillation column (A). The extractive distillation column (A) is usually operated at a pressure of 1 to 20 atmospheres. Paraffins and/or olefins which are relatively difficultly soluble in the polar solvent are discharged as a raffinate from the top of the column through line 11, and olefins and/or diolefins which are relatively easily soluble in the polar solvent are withdrawn from the bottom of the column through line 1.

Figure 2:
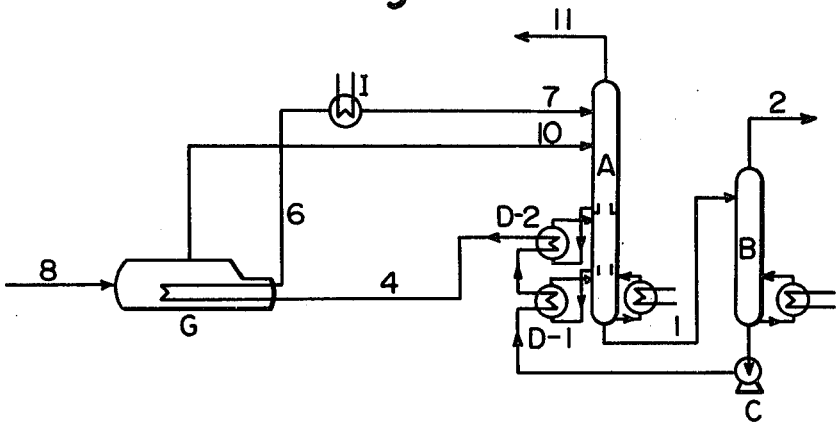
FIG. 2 is a diagram showing a comparative method.

In the method (comparison) shown in FIG. 2, the extractive distillation column (A) and the stripping column (B) are operated in the same way as in FIG. 1. However, the polar solvent from the reboiler (D-2) at the bottom of the extractive distillation column is directly sent to a single evaporator (G). The gas evaporated there has a pressure sufficient for feeding to the extractive distillation column (A). Since the polar solvent discharged from the evaporator (G) has too high a temperature for feeding into the extractive distillation column (A), it must be cooled with cooling water in a cooler (I) before it is fed to the extractive distillation column (A). According to the method of FIG. 2, the heat of the polar solvent cannot be recovered by the reboiler (F) of the rectifying column (E) as in the method shown in FIG. 1.

The following examples illustrate the method of the present invention specifically.

EXAMPLE

The apparatus shown in FIG. 1 was used.

The hydrocarbon mixture shown in Table 2 in gaseous form was fed at a rate of 150 kg/hour to the middle of extractive distillation column (A) composed of 100 trays through line 10, and a polar solvent was fed at a flow rate of 1000 kg/hour and a temperature of 40° C. to a position several trays below the top of the extractive distillation column through line 7.

By operating the apparatus under the following conditions, 88.2 kg/hour of a mixture of relatively difficultly soluble hydrocarbons was obtained from the top of the extractive distillation column.

Column top pressure: 3.0 kg/cm$^2$.G
Column top temperature: 35° C.
Reflux liquid: 100 kg/hour
Column bottom temperature: 145° C.

The stripping column (B) was operated at a pressure of 0.1 kg/cm$^2$.G and a column bottom temperature of 163° C. From the top of the stripping column, a mixture of relatively easily soluble hydrocarbons was obtained at a rate of 61.8 kg/hour. This hydrocarbon mixture is sent to the subsequent rectifying step and purified. The polar solvent at a high temperature (163° C.) from the bottom of stripping column was sent to reboilers (D-1) and (D-2) at the bottom of the extractive distillation column (A) through pump (C) and line 3 to recover its heat. The temperature of the solvent at line 4 at the exit of the reboiler (D-2) was 82° C.

The polar solvent was then sent to the reboiler (F) at the bottom of the rectifying column (E), and gave the reboiler heat in an amount of 7,500 Kcal/hour. The temperature of the polar solvent at line 5 at the exit of the reboiler was 67° C. The polar solvent at 67° C. was then successively sent to the evaporators (G-1) and (G-2), and heat was recovered from it until it was cooled to 40° C. Thereafter, the polar solvent was recycled to the extractive distillation column (A) through line 7.

The hydrocarbon gases from the first evaporator (G-1) had a pressure of 4.0 kg/cm$^2$.G, and therefore could be fed directly to the extractive distillation column (A). But since the hydrocarbon gas from the second evaporator had a pressure of 3.0 kg/cm$^2$.G, it was boosted to 4.0 kg/cm$^2$.G and then fed to the extractive distillation column.

The total amount of steam required in the extractive distillation column (A) and the stripping column (B) was 51 kg/hour.

The compositions of the starting hydrocarbon mixture, and the separated relatively difficultly hydrocarbons and relatively easily soluble hydrocarbons are shown in Table 2.

The polar solvent used was a mixture of anhydrous dimethylformamide with 0.1% by weight of nitrobenzene and 0.05% by weight of sodium nitrite.

TABLE 2

| Compound | Starting hydrocarbon mixture from line 10 | Relatively difficultly soluble hydrocarbons from line 11 | Relatively easily soluble hydrocarbons from line 2 |
|---|---|---|---|
| iso-Butane | 2.50% | 4.25% | —% |
| n-Butane | 8.61 | 14.63 | — |
| Butene-1 | 14.52 | 24.67 | — |
| iso-Butene | 23.22 | 39.48 | — |
| trans-Butene-2 | 6.17 | 10.47 | 0.02 |
| cis-Butene-2 | 4.08 | 6.25 | 0.97 |
| 1, 3-Butadiene | 39.68 | 0.30 | 96.04 |
| Methylacetylene | 0.04 | — | 0.10 |
| 1, 2-Butadiene | 0.29 | — | 0.70 |
| Ethylacetylene | 0.18 | — | 0.44 |
| Vinylacetylene | 0.71 | — | 1.73 |
| | 100 | 100 | 100 |

COMPARATIVE EXAMPLE

The apparatus shown in FIG. 2 was used. The same extractive distillation column (A) and stripping column (B) as in the prior Example were used. The composition of the starting hydrocarbon mixture, the feeding position of the extractive distillation column and the other operating conditions and the polar solvent used were the same as in the prior Example.

From the stripping column, the polar solvent at a high temperature (163° C.) was discharged and sent to the reboilers (D-1) and (D-2) at the bottom of the extractive distillation column through the pump (C) and line 3 to recover heat. The temperature of the solvent at line 4 at the exit of the reboiler (D-2) was 82° C. The polar solvent was directly sent to the material evaporator (G) and heat was recovered until it was cooled to 55° C. The gas from the evaporator was 4.0 kg/cm$^2$.G, and therefore, fed to the extractive distillation column (A) directly. In the meantime, the polar solvent from the evaporator was cooled to 40° C. by cooler (I), and recycled to the extractive distillation column (A).

When in the Comparative Example, the heat of the solvent was recovered at the reboiler (F) of the rectifying column (E) as in the prior Example, the amount of heat for feeding into the evaporator (G) was insufficient. Hence, the gas from the evaporator could not be fed to the extraction distillation column without a compressor.

The total amount of steam required in the extractive distillation column (A), the stripping column (B) and the rectifying column (E) was 65 kg/hour, showing an increase of 28% from that required in the prior Example. The amounts of the relatively difficultly soluble hydrocarbons and relatively easily soluble hydrocarbons separated were much the same as in the prior Example.

We claim:

1. In a method for separating a hydrocarbon mixture into relatively difficultly soluble hydrocarbons and relatively easily soluble hydrocarbons by extractive distillation using a polar solvent comprising feeding the starting hydrocarbon mixture through at least two evaporators, an extractive distillation column, a stripping column and a rectifying column; the improvement wherein (1) the polar solvent discharged at a high temperature from the bottom of the stripping column is recycled to the extractive distillation column after it has been cooled to a suitable temperature by giving up heat to a reboiler of the extractive distillation column, a reboiler of the rectifying column and successively to the evaporators, and (2) the starting hydrocarbon mixture is divided into at least two streams and heated in at least two evaporators, one stream being evaporated in a first evaporator to a pressure necessary for introduction into the extractive distillation column and then fed to the extractive distillation column, and the other stream after evaporation in a second and subsequent evaporator, being pressurized to a pressure required for introduction into the extractive distillation column by means of a compressor and then fed to the extractive distillation column.

2. The method of claim 1 wherein the relatively difficultly soluble hydrocarbons are paraffins, and the relatively easily soluble hydrocarbons are olefins.

3. The method of claim 1 wherein the relatively difficultly soluble hydrocarbons are olefins, and the relatively easily soluble hydrocarbons are diolefins.

4. The method of claim 1 wherein the starting hydrocarbon mixture is a $C_4$ hydrocarbon mixture, and 1,3-butadiene as the relatively easily soluble hydrocarbon is separated from the mixture.

5. The method of claim 1 wherein the starting hydrocarbon mixture is a $C_4$ paraffin-olefin mixture, and separated into paraffins as the relatively difficultly soluble hydrocarbons and olefins as the relatively easily soluble hydrocarbons.

6. The method of claim 1 wherein the starting hydrocarbon mixture is a $C_5$ hydrocarbon mixture and isoprene as the relatively easily soluble hydrocarbon is separated from the mixture.

7. The method of any one of claims 1 to 6 wherein the polar solvent is at least one solvent selected from the group consisting of N-alkyl-substituted lower fatty acid amides, furfural, N-methylpyrrolidone, formylmorpholine, β-methoxypropionitrile and acetonitrile.

* * * * *